US007343850B2

(12) United States Patent
Gerl

(10) Patent No.: US 7,343,850 B2
(45) Date of Patent: Mar. 18, 2008

(54) COOKING APPLIANCE WITH AN EXTRACTOR FAN

(75) Inventor: Josef Gerl, Palling (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 303 days.

(21) Appl. No.: 10/733,911

(22) Filed: Dec. 10, 2003

(65) Prior Publication Data

US 2005/0077288 A1 Apr. 14, 2005

Related U.S. Application Data

(63) Continuation of application No. PCT/EP02/06270, filed on Jun. 7, 2002.

(30) Foreign Application Priority Data

Jun. 12, 2001 (DE) ..... 101 28 369

(51) Int. Cl.
*A23L 1/00* (2006.01)

(52) U.S. Cl. ..... 99/332; 99/476; 219/401; 219/494; 219/702; 219/710

(58) Field of Classification Search ..... 99/419–421 V, 99/400, 401, 341, 444–450, 467–472, 485, 99/486, 327–333; 126/25 R, 9 R, 214; 219/494, 219/497, 388, 392, 400, 401, 702–710
See application file for complete search history.

(56) References Cited

U.S. PATENT DOCUMENTS 5,044,262 A * 9/1991 Burkett et al. ..... 99/327
5,097,759 A * 3/1992 Vilgrain et al. ..... 99/483
5,485,780 A 1/1996 Koether et al.

FOREIGN PATENT DOCUMENTS

EP 0545012 B1 * 6/1993
EP 0950861 A1 10/1999

* cited by examiner

*Primary Examiner*—Timothy F. Simone
(74) *Attorney, Agent, or Firm*—Russell W. Warnock; James E. Howard

(57) ABSTRACT

A cooking appliance including at least one heating unit for heating a cooking area and including at least one extractor fan. At least one parameter of the extractor fan can be controlled to different values by a control unit, regardless of the selected cooking mode. At least one parameter value is stored in an electronic storage unit.

6 Claims, 2 Drawing Sheets

COOKING APPLIANCE WITH AN EXTRACTOR FAN

Figure 1:
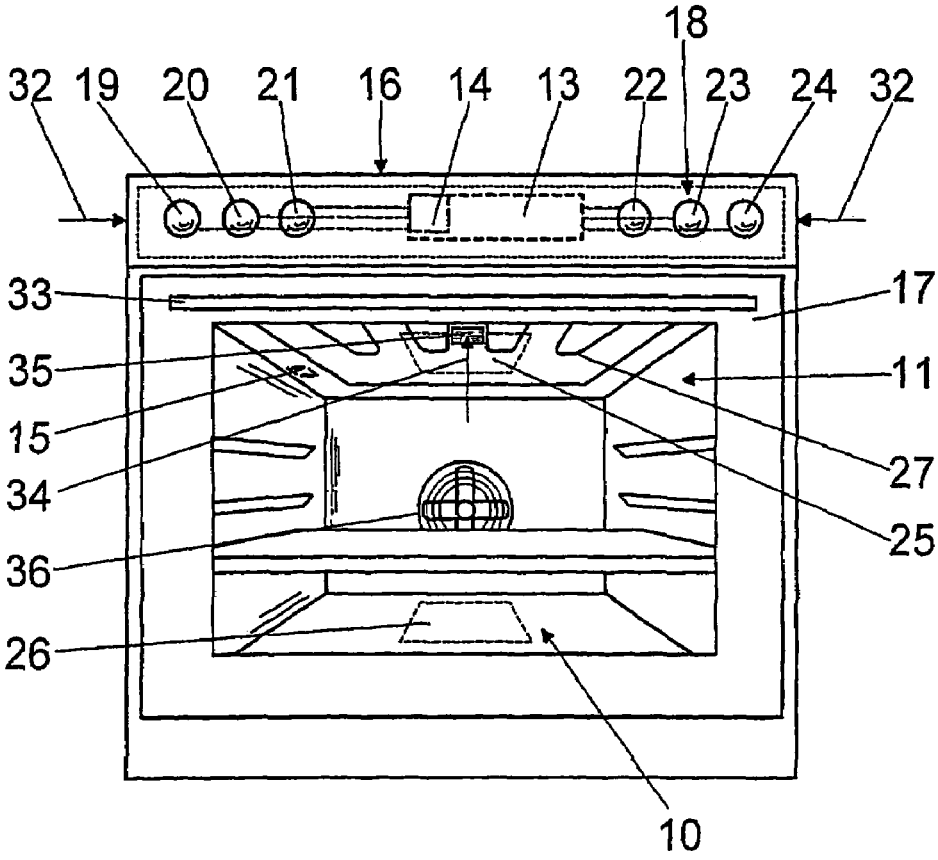

The invention is based on a cooking appliance in accordance with the preamble of claim 1.

EP 0 545 012 B1 discloses a generic cooking appliance with a fan, serving as cooling fan and as extractor fan. The cooking appliance has a control unit with a circuit arrangement for controlling the fan. The fan or a fan motor is wired on one side to a neutral conductor and on the other side to a resistor which can be bridged by a switch. Depending on the position of an operating mode reversing switch the resistor is connected directly to an alternating current source or is connected in series to a temperature sensor. The temperature sensor, which is heated electrically separately in operation, closes a contact after approximately 3 minutes as a result of heating, and at the same time connects the fan motor to the alternating current source via the resistor and via the contact, with the operating mode reversing switch in the corresponding position. It is this circuit arrangement which results in a control dependent on the operating mode selected with the operating mode reversing switch.

The object of the invention is to provide a generic cooking appliance with particularly flexible and precise control of the extractor fan, at the same time keeping structural complications to a minimum. This task is solved according to the present invention by the characteristics of claim 1, while advantageous configurations and further developments of the invention can be viewed in the sub-claims.

The invention is based on a cooking appliance having at least one heating unit, by means of which a cooking area can be heated, and with at least one extractor fan, by which at least one parameter, depending on a selected cooking mode, can be regulated via a control unit to different parameter values.

It is proposed that at least one parameter value is stored in an electronic storage unit. Particularly flexible, secure and cost-effective control can be achieved with minimal structural complication. In particular, with countless types of cooking mode and by means of different cooking mode programs phased operation of the extractor fan can be constantly achieved advantageously, in that several parameters, such as switch-on time, that is, an interval between the beginning of a cooking operation and the start of the extractor fan, switch-on duration, run-on time, fan speed and the like, can be set to several different parameter values. Extractor fan programs phased for different cooking mode programs can be achieved, power can be spared and interference can be avoided by an unnecessary extractor fan mode.

Types of cooking modes are understood to mean operating modes with various temperatures and operating modes, which are configured for different cooking vessels and/or for different cooking items, and in particular operating modes with different use of heating elements, such as for example a heating element for top heating, a heating element for bottom heating, a grill heating element and/or a microwave heating element and the like.

Furthermore, with the solution according to the present invention components which are already present can be used advantageously, and additional components, such as additional sensors in particular and the like, can be avoided. The control unit can be designed advantageously at least partly monobloc with a control unit, by means of which the heating unit can be regulated, and/or the storage unit can be designed advantageously at least partly monobloc with a storage unit, in which at least one cooking mode parameter is stored.

Additional structural space, assembly complications as well as additional costs can be avoided accordingly.

The storage unit can be made up of different non-volatile memories, deemed appropriate by the expert. However, so-called EPROMs (Erasable Programmable Read Only Memory) and in particular EEPROMs (Electric Erasable Programmable Read Only Memory) can be used particularly advantageously, and can be wiped and reprogrammed. In the process the storage unit can be programmed by the manufacturer to specific boundary conditions particularly flexibly.

In a further configuration of the invention is it suggested that the extractor fan can be regulated by the control unit depending on at least one value detected by a sensor, for example depending on a detected temperature value and in particular depending on a detected humidity value in the cooking area and the like. In particular, an additional security function can be incorporated. In addition, a learning system can advantageously be achieved by the stored parameter value being changeable depending on the value detected by the sensor. Automatic adaptation of the cooking appliance to present changing boundary conditions can be achieved, such as for example to present ambient temperature, humidity and the like, and aging phenomena can be compensated.

If the extractor fan is designed monobloc with a cooling fan, then an additional fan for cooling temperature-sensitive components can be omitted and cooling dependent on the cooking mode can be achieved to advantage. The stored parameter values can also be phased to the cooling beneficial to each type of cooking mode.

Further advantages will emerge from the following description of the diagrams. The diagram illustrates an embodiment of the invention. The diagram, the description and the claims contain countless features in combination. The specialist will also observe the features appropriately separately and will assemble them into meaningful combinations.

Figure 2:
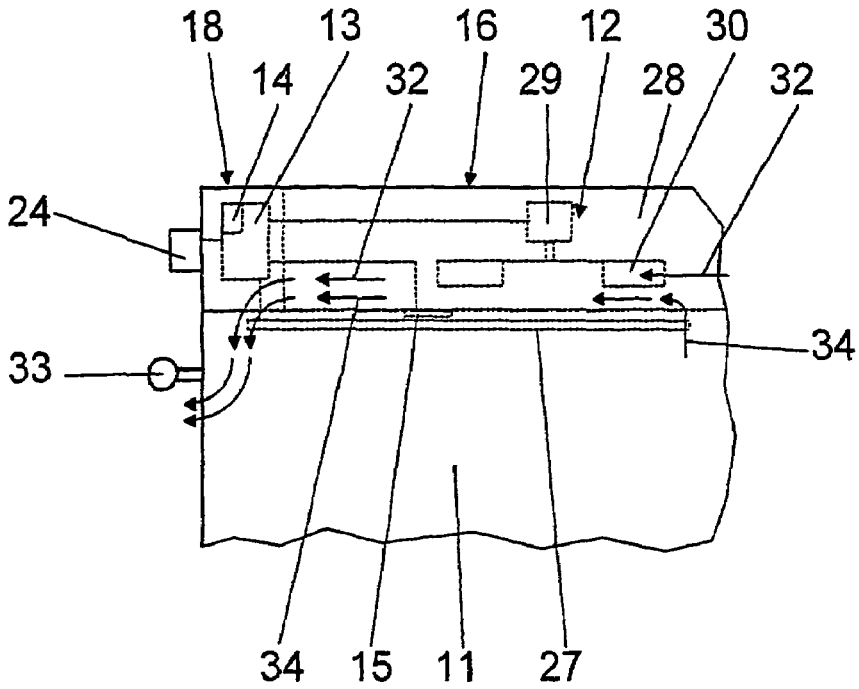
Figure 3:
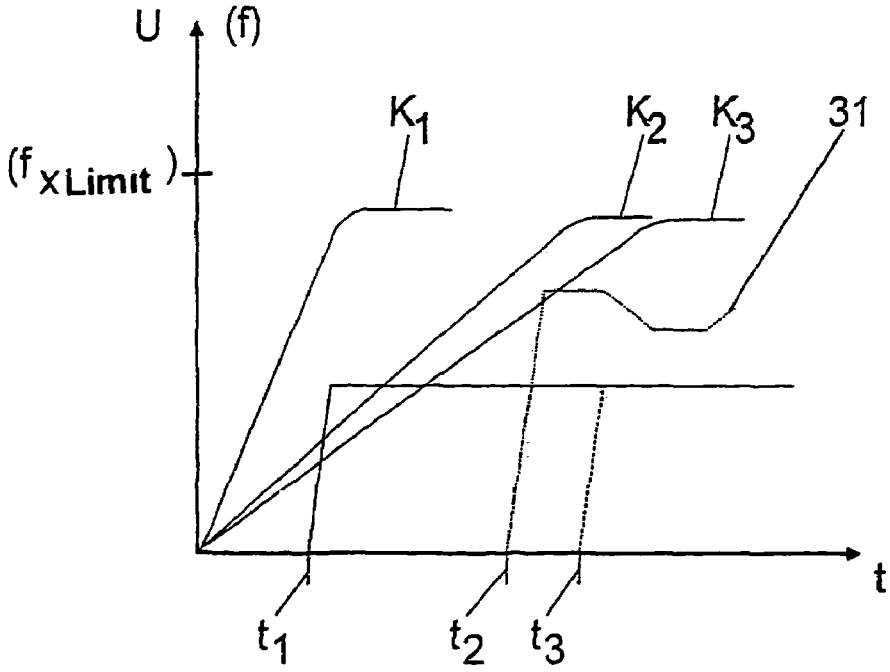

FIG. 1 shows a schematically illustrated domestic oven appliance in a front elevation, FIG. 2 shows a section of a side elevation of the domestic oven appliance from FIG. 1 with an extractor fan, and FIG. 3 is a diagram with registered switch-on times for different cooking mode types.

FIG. 1 shows a schematically illustrated domestic oven appliance with a baking oven housing, in which a cooking area 11 is arranged. The cooking area 11 can be sealed with a swivel-mounted door 17 and can be heated with a heating unit 10, which has a heating element 25 in its top region for top heating, a heating element 26 in the floor region for bottom heating and a heating spiral 27 for grilling in the top region.

An air current for circulating mode can be generated using a fan 36 in the rear region.

The domestic oven appliance also has a control panel 18 with six rotatable control elements 19, 20, 21, 22, 23, 24. By way of the three first rotatable control elements 19, 20, 21 (from the left in the diagram) temperatures of heating elements (not illustrated in detail) of a cooking vat 16 can be set, which is arranged above the domestic oven appliance. By way of the three other rotatable control elements 22, 23, 24 different types of cooking modes can be set, that is, different cooking temperatures in the cooking area 11 with differing use of the heating elements 25, 26, 27.

Arranged above the cooking area 11 in a cavity 28 of the baking oven housing is an extractor fan 12 with an electrically operated fan motor 29 and an impeller 30 (FIG. 2). The purpose of the extractor fan 12 is to convey water vapour 34 out of the cooking area 11 to the exterior. To this end the extractor fan 12 suctions the water vapour 34 through an opening 35 in the top region of the cooking area 11 and conveys the water vapour 34 through a channel system (not shown in detail) via the control panel 18 to a blower aperture beneath a door handle 33. Furthermore, the extractor fan 12 is designed monobloc with a cooling fan and its purpose is to cool the control panel 18 with its electronic components. To this end the extractor fan 12 sucks in fresh air 32 through side walls of the cooking oven housing and conveys the fresh air 32 together with the water vapour 34 via the channel system to the exterior.

A switch-on time t of the extractor fan 12, that is, an interval from the beginning of a cooking mode selected via the control element 22, 23, 24 to the start of the extractor fan 12 can be controlled by a control unit 13 depending on the selected cooking mode to different switch-on time parameters $t_1$, $t_2$, $t_3$, whereby the switch-on time parameters $t_1$, $t_2$, $t_3$ are stored in an electronic storage unit 14, and in an EEPROM (FIGS. 2 and 3). During a cooking mode with the heating spiral 27 or during grilling the extractor fan 12 is started with a switch-on time parameter $t_1$ of 3 minutes, in a cooking mode with the heating elements 25, 26 or during baking and roasting the extractor fan 12 is started with a switch-on time parameter $t_2$ of 8 minutes and with a cooking mode program for a cooking mode with a closed cooking vessel the extractor fan 12 is started with a switch-on time parameter $t_3$ of 10 minutes. Characteristic lines $K_1$, $K_2$, $K_3$ for the respective water vapour 34 over the time t are shown for cooking modes in the diagram in FIG. 3. The extractor fan 12 switches on essentially at the different cooking modes always with the same quantity of water vapour and is always operated at the same speed U.

Instead of operating the extractor fan 12 at only a speed U, the former could also be operated with an extractor fan operation program adapted to a cooking mode program at various speeds over the time t, as is indicated with a characteristic line 31 in FIG. 3.

Disposed inside the cooking area 11 is a humidity sensor 15 connected to the control unit 13. Should the humidity f inside the cooking area 11 exceed a preset humidity limit parameter $f_{xLimit}$ before the extractor fan 12 is started, the latter is activated via the control unit 13. Apart from an additional security function a self-learning system could also be achieved with the humidity sensor 15, and speed parameters of the extractor fan 12 stored for example in the storage unit 14 depending on detected humidity values $f_x$ are corrected.

The control unit 13 is designed monobloc with a control unit, by means of which the heating unit 10 and a cooking vat 16 can be controlled, and the storage unit 14 is designed monobloc with a storage unit, in which cooking mode parameters, cooking mode programs and cooking operation values are stored.

LEGEND

10 heating unit
11 cooking area
12 extractor fan
13 control unit
14 storage unit
15 sensor
16 cooking vat
17 door
18 control panel
19 control element
20 control element
21 control element
22 control element
23 control element
24 control element
25 heating element
26 heating element
27 heating element
28 cavity
29 fan motor
30 impeller
31 characteristic line
32 fresh air
33 door handle
34 water vapour
35 opening
36 fan
t parameter
$t_1$ parameter value
$t_2$ parameter value
$t_3$ parameter value
f parameter
$f_x$ parameter value
U speed

The invention claimed is:

1. A cooking appliance having at least one heating unit for heating a cooking area and including at least one extractor fan, comprising:

a control unit for regulating a switch-on time for said extractor fan from one of a plurality of different switch-on times depending upon a selected cooking mode; and an electronic storage unit coupled to said control unit and having at least one of said switch-on times stored in said electronic storage unit.

2. The cooking appliance according to claim 1, including said control unit formed at least partly monobloc with a second control unit to control said heating unit.

3. The cooking appliance according to claim 1, including said electronic storage unit formed at least partly monobloc with a second storage unit in which said at least one cooking mode value is stored.

4. The cooking appliance according to claim 1, including a humidity sensor coupled to said control unit, said extractor fan being controlled by a predetermined value detected by a humidity sensor.

5. The cooking appliance according to claim 4, wherein said storage unit stores a plurality of switch-on time parameters with each switch-on time parameter being associated with a given cooking mode and each switch-on time parameter being a respective time interval associated with a respective cooking mode, the switching on of said extractor fan being effected upon the expiration of the respective time interval associated with a respective given cooking mode selected by a user, said humidity sensor is operable to sense humidity levels relative to the cooking area, and said control unit is operatively connected to said humidity sensor and, in connection with each given cooking mode, said control unit is operable, upon the sensing by said humidity sensor of a humidity level exceeding a predetermined humidity level, to switch on said extractor fan at a time before the time of expiration of the respective time interval associated with said given cooking mode at which said extractor fan would have otherwise been switched on.

6. The cooking appliance according to claim 1, including said extractor fan is formed monobloc with a cooling fan.

* * * * *